US007806178B2

(12) United States Patent
Dyson et al.

(10) Patent No.: US 7,806,178 B2
(45) Date of Patent: Oct. 5, 2010

(54) WIRE WRAP SCREEN MANUFACTURING METHOD

(75) Inventors: Kendall R. Dyson, St Martinville, LA (US); Simon Angelle, Arnaudville, LA (US)

(73) Assignee: Baker Hughes Incorporated, Houston, TX (US)

( * ) Notice: Subject to any disclaimer, the term of this patent is extended or adjusted under 35 U.S.C. 154(b) by 34 days.

(21) Appl. No.: 12/138,192

(22) Filed: Jun. 12, 2008

(65) Prior Publication Data

US 2009/0308596 A1 Dec. 17, 2009

(51) Int. Cl.
*E21B 43/08* (2006.01)
*B23P 21/00* (2006.01)

(52) U.S. Cl. ..... 166/227; 166/233; 29/896.62

(58) Field of Classification Search ..... 166/380, 166/227, 233, 234; 29/896.62
See application file for complete search history.

(56) References Cited

U.S. PATENT DOCUMENTS 3,875,977 A 4/1975 Colburn et al.
4,314,129 A * 2/1982 Wilson et al. ..... 219/58
4,415,396 A 11/1983 Wagner
4,914,514 A 4/1990 Smith et al.
5,611,399 A 3/1997 Richard et al.
5,738,170 A 4/1998 Lavernhe
6,305,468 B1 10/2001 Broome et al.
6,663,774 B2 12/2003 Flansburg et al.
7,281,319 B1 * 10/2007 Allford ..... 29/703
2009/0008085 A1 * 1/2009 Roaldsnes ..... 166/233
2009/0078403 A1 * 3/2009 Langlais ..... 166/56

OTHER PUBLICATIONS

Dikken, Ben J., Pressure Drop in Horizontal Wells and Its Effect on Production Performance; Society for Petroleum Engineers, Nov. 1990; 1426-1433.
Gillespie, G., et al., "Screen Development to Withstand 4,000-psi Overbalance, Subhydrostatic Completion in Deepwater GOM Subsea Waterflood Injector Wells", SPE 116091, Sep. 2008, 1-18.
Underdown, David R., et al., "Design and Implementation of Retention/Filtration Media for Sand Control", SPE Drilling and Completion, Sep. 2008, 235-241.
Underdown, David R., et al., "Design and Implementation of Retention/Filtration Media to Improve Heavy Oil Production", SPE 103782, Dec. 2006, 1-6.
Gillespie, G., et al., "Collapse and Burst Test Methods for Sand Screens", SPE 116094, Sep. 2008, 1-15.

* cited by examiner

*Primary Examiner*—William P Neuder
(74) *Attorney, Agent, or Firm*—Steve Rosenblatt

(57) ABSTRACT

Non conductive supports flank the mounting location of ribs for a wire wrap screen so as to limit penetration into the wire being fed over the ribs and resistance welded notwithstanding variations of applied force from the weld roller. Optionally the wire can be pre-rolled to approximately its end diameter in the finished screen ahead of the time it contacts a rib so as to minimize bending the wire over the rib which thins the wire. The supports are preferably ceramic and provide equal penetration of the rib into the wrap wire despite variations in loading by the weld roller.

17 Claims, 1 Drawing Sheet

WIRE WRAP SCREEN MANUFACTURING METHOD

FIELD OF THE INVENTION

The field of the invention is manufacturing techniques for making wire wrap screen.

BACKGROUND OF THE INVENTION

Wire wrap screens are made by putting a series of longitudinal ribs in a circular arrangement an having each rib extend radially beyond a hub that places all the ribs in a cylindrical arrangement. A wrap wire is passed between the a weld roller and the ribs in succession as the hub rotates on its axis and the ribs are drawn along axes parallel to the axis of rotation of the hub. The weld roller is adjusted for the amount of force it places on the wrap wire. Current is applied as the wrap wire encounters a rib to effect a resistance weld.

The problem with this technique is that the wrap wire can neck down or get thinner as a result of uneven force applied to the wire from the weld roller. Additionally, if the wire is bent as it contacts a rib such bending also contributed to necking down when resistance welding the wrap wire to the ribs.

The present invention addresses this issue by straddling ribs with non-conductive and preferably ceramic supports so that the ribs extend radially only a fixed distance beyond the supports. This limits the penetration of the wire under pressure from the roller regardless of the roller force setting. As a result the penetration is uniform when the welding takes place. As an option, the wire can be pre-rolled to approximately the end diameter of the screen being made before there is rib contact as a way of reducing bending at the rib contact for the wire. This can be done with a set of opposed rollers through which the wire is fed before it contacts a rib mounted to the screen head. U.S. Pat. No. 3,875,977 is relevant to pre-rolling wrap wire.

These and other aspects of the present invention will become more readily apparent from the detailed description of the preferred embodiment and the associated drawings while recognizing that the full scope of the invention is given by the claims.

SUMMARY OF THE INVENTION

Non conductive supports flank the mounting location of ribs for a wire wrap screen so as to limit penetration into the wire being fed over the ribs and resistance welded notwithstanding variations of applied force from the weld roller. Optionally the wire can be pre-rolled to approximately its end diameter in the finished screen ahead of the time it contacts a rib so as to minimize bending the wire over the rib which thins the wire. The supports are preferably ceramic and provide equal penetration of the rib into the wrap wire despite variations in loading by the weld roller.

DETAILED DESCRIPTION OF THE PREFERRED EMBODIMENT

Figure 4:
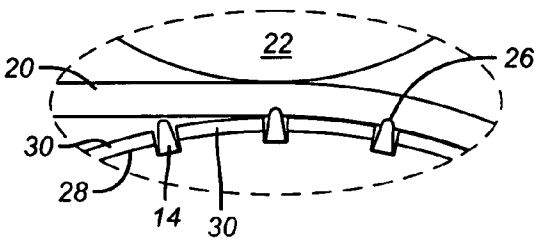
FIG. 4 is an enlarged view of the interface among the weld roller, the screen head and the wrap wire as welding occurs.

The screen head 10 has a plurality of notches 12 along its edge where ribs 14 are inserted. The screen head is a drum that is rotated about its center 16 while maintaining the relative positions of the ribs 14 in the notches 12. The ribs 14 are pulled in tandem relative to their notches 12 in the direction of arrow 18 as the screen head 10 is driven on its axis 16 and wrap wire 20 is fed between the screen head 10 and the weld roller 22. Arrow 24 represents an adjustment of normal force that is applied against the wrap wire 20 by roller 22. FIG. 4 shows that the pointed ends 26 of each of the ribs 14 penetrate into wrap wire 20 as a result of application of force 24 from the weld roller 22.

In operation, electric current is supplied through the weld roller 22 which results in fusing the wrap wire 20 that comes in contact with a rib 14. In the past there was an issue of uneven penetration of the ends 26 into the wrap wire 20 caused by fluctuation of pressure during operations as depicted by arrow 24. The roller 22 used to force the wrap wire 14 right onto the rib ends 26 with no backstop. As a result if the force represented by arrow 24 varied during operations the penetration of ends 26 of ribs 14 would also vary.

To address this issue, the outer surface 28 of the screen head 10 has been fitted with non-conductive segments 30 that preferably straddle each rib 14. Now the variability of force 24 is irrelevant as the amount of penetration of rib ends 26 is structurally limited by the presence of the preferably ceramic segments that act as a travel stop. In the arrangement of FIG. 4, the penetration of rib ends 26 into the wrap wire 20 is uniform and as long as a minimum pressure exists represented by arrow 24 the ends 26 have the same penetration with each encounter with a rib 14.

While the screen head 10 rotates about axis 16 and the ribs 14 are advanced with respect to their notches 12, the weld roller 22 feeds wrap wire 20 to form a cylindrical shape with spiral wound wrap wire 20 with a resistance weld at each intersection of the wrap wire 20 with a rib 14.

Figure 1:
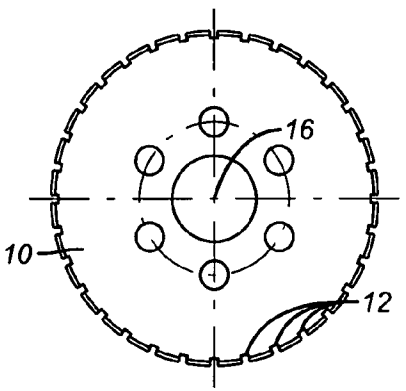
FIG. 1 is a section view of the screen head showing the placement of the wire wrap supports.
Figure 2:
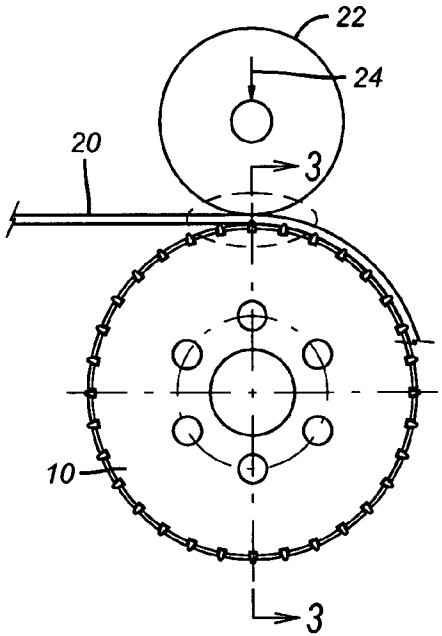
FIG. 2 is the view of FIG. 1 adding the weld roller and the wrap wire being fed.
Figure 3:
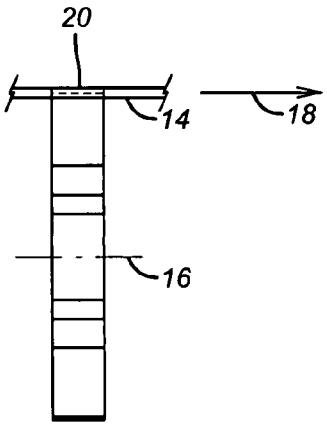
FIG. 3 is the view along lines 3-3 of FIG. 2.
Figure 5:
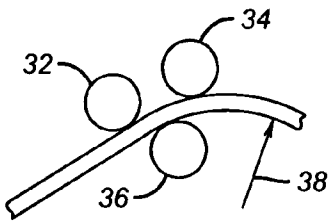
FIG. 5 shows a collection of rollers to pre-bend the wrap wire to an arc with the approximate radius of the screen head.
Figure 6:
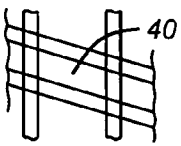
FIG. 6 shows the uniform gaps made from spiral winding the wrap wire when it is pre-bent.

The wrap wire 20 can be fed by the weld roller tangentially as shown in FIG. 2. However, one issue of doing so is necking down as the wire wrap 20 is forced to make a bend over the rib 14 as the screen head 10 continues to rotate. One way to minimize this necking down of the wrap wire 20 width which can cause variation in the opening size of the finished screen is to pre-roll the wrap wire 20 using rollers 32 and 34 on an opposed side of wrap wire 20 from roller 36 so as to create an arc in the wrap wire with an approximate radius of the outer surface of the screen head 10 or segments 30 on the screen head 10, represented by arrow 38 in FIG. 5. The gaps between windings 40 are uniform as shown in FIG. 6.

The above description is illustrative of the preferred embodiment and many modifications may be made by those skilled in the art without departing from the invention whose scope is to be determined from the literal and equivalent scope of the claims below:

We claim:

1. A method of manufacturing a screen, comprising:

arranging a plurality of ribs in a predetermined array on a support;

flanking said ribs with segments so as to allow a predetermined extension of rib ends beyond said segments;

feeding a wrap wire over said ribs;

joining said wrap wire to said ribs.

2. The method of claim 1, comprising:
using said segments to limit rib penetration into said wrap wire when said wrap wire is pushed against said ribs.

3. The method of claim 2, comprising:
removably mounting said segments to said support.

4. The method of claim 3, comprising:
making said segments non-conductive.

5. The method of claim 4, comprising:
making said segments from a ceramic material.

6. The method of claim 2, comprising:
making said penetrations by said ribs into said wrap wires uniform.

7. The method of claim 6, comprising:
making said penetrations by said ribs into said wrap wires uniform despite variation of pressure that forces them together above a threshold value.

8. The method of claim 7, comprising:
providing a circular support for said ribs;
bending said wrap wire into an arc before it contacts a rib on said support.

9. The method of claim 8, comprising:
making said arc have a radius substantially equal to a radius of said support.

10. The method of claim 8, comprising:
making said arc have a radius substantially equal to a radius of said segments.

11. The method of claim 10, comprising:
joining said wrap wire to said ribs with resistance welding.

12. The method of claim 11, comprising:
using a weld roller to feed wrap wire and press it against said ribs for said resistance welding while moving said ribs in a direction perpendicular to the feed direction of said wrap wire.

13. A wire wrap screen, comprising:
a series of ribs held together by a wrap wire;
said ribs penetrate uniformly into said wrap wire;
said ribs are initially spaced in a circular pattern by a support coupled with flanking said ribs by segments on said support that limit rib end extension so as to limit penetration of wrap wire pressed against said ribs and said segments while being joined to said ribs.

14. The screen of claim 13, wherein:
said segments are non-conductive of electrical current and removably mounted to said support.

15. The screen of claim 14, wherein:
said segments are made of a ceramic material.

16. The screen of claim 15, wherein:
said wrap wire is pre-bent to approximately a radius formed by said segments before making contact with any rib.

17. The screen of claim 16, wherein:
said wrap wire is joined to said ribs by resistance welding.

* * * * *